United States Patent [19]

Norwood et al.

[11] 4,364,405

[45] Dec. 21, 1982

[54] CRUTCH CONTAINING A RETRACTABLE METAL POINT

[76] Inventors: Robert F. Norwood, 474 Main St.; Robert S. Harper, 86 Highland Ave., both of Greenfield, Mass. 01301

[21] Appl. No.: 197,690

[22] Filed: Oct. 16, 1980

[51] Int. Cl.[3] ..... A61H 3/02

[52] U.S. Cl. ..... 135/70; 135/81

[58] Field of Search ..... 135/68, 69, 70, 71, 135/72, 73, 75, 76, 77, 78, 79, 80, 81, 82

[56] References Cited

U.S. PATENT DOCUMENTS

| | | | |
|---|---|---|---|
| 332,808 | 12/1885 | Ladomus | 135/70 |
| 1,003,103 | 9/1911 | Harding | 135/70 |
| 1,090,960 | 3/1914 | Appelman | 135/70 |
| 1,164,608 | 12/1915 | Care | 135/70 |
| 1,284,991 | 11/1918 | Beegroft | 135/80 |
| 1,349,639 | 8/1920 | Taylor et al. | 135/68 |
| 2,358,853 | 9/1944 | Dunnicliff | 135/70 |
| 2,371,246 | 3/1945 | McGrory et al. | 135/70 |
| 3,448,749 | 6/1969 | Stark | 135/70 |
| 3,901,258 | 8/1975 | Montgomery | 135/68 |

FOREIGN PATENT DOCUMENTS

| | | | |
|---|---|---|---|
| 808608 | 7/1951 | Fed. Rep. of Germany | 135/81 |
| 2124824 | 11/1972 | Fed. Rep. of Germany | 135/80 |

*Primary Examiner*—Richard C. Pinkham
*Assistant Examiner*—Arnold W. Kramer
*Attorney, Agent, or Firm*—Larson and Taylor

[57] ABSTRACT

A crutch containing a retractable metal point wherein an elongated lower central member, adjustably secured between longitudinal support members of the crutch, houses a first retractable elongated metal rod pointed at one end and connected at its other end to a second retractable rod of reduced diameter which passes through a hollow hub disposed at the top of the central member. The hub is provided with a slot through which a pin is connected to said second rod and radially projects outwardly. A spring circumscribes the second rod and applies a spring loading to the first rod when in projected position. A resilient end cap fits over the end of the elongated member and contains an axial bore and an aperatured metal plate through which the metal point projects when in projected position. To retract the metal point the connected metal rods are pulled up on a knurled rod attached to the top of the second rod until the rod is out of the slot and then the knob twisted to rotate the pin and lock it in a seat on top of the hub.

5 Claims, 6 Drawing Figures

FIG. 1
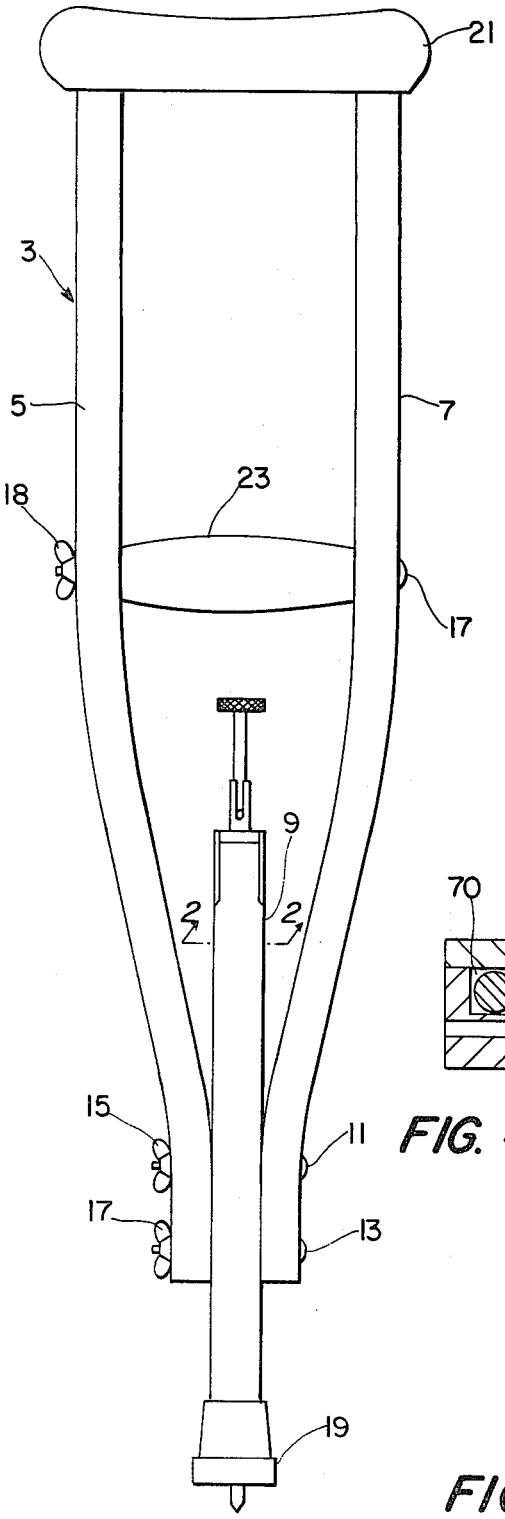
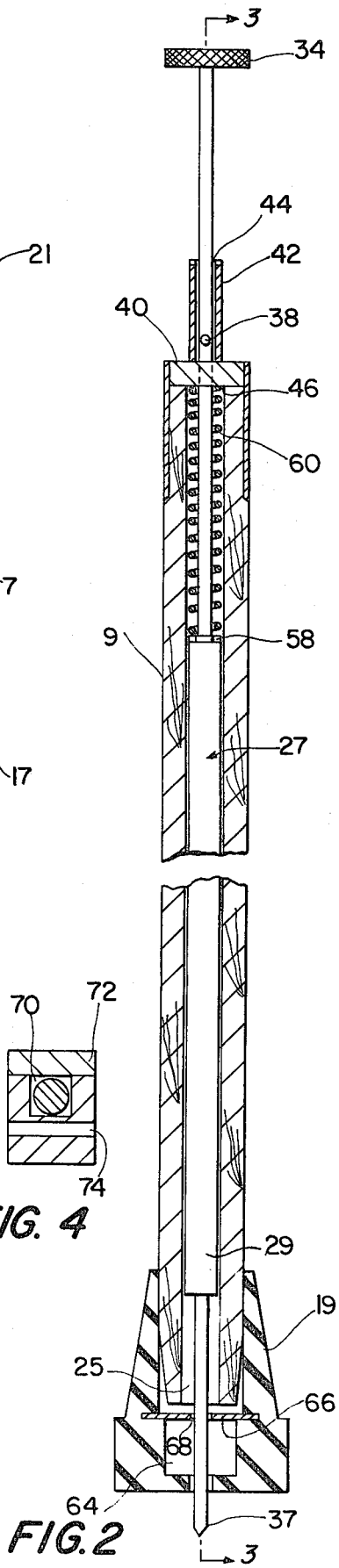
FIG. 2
FIG. 4
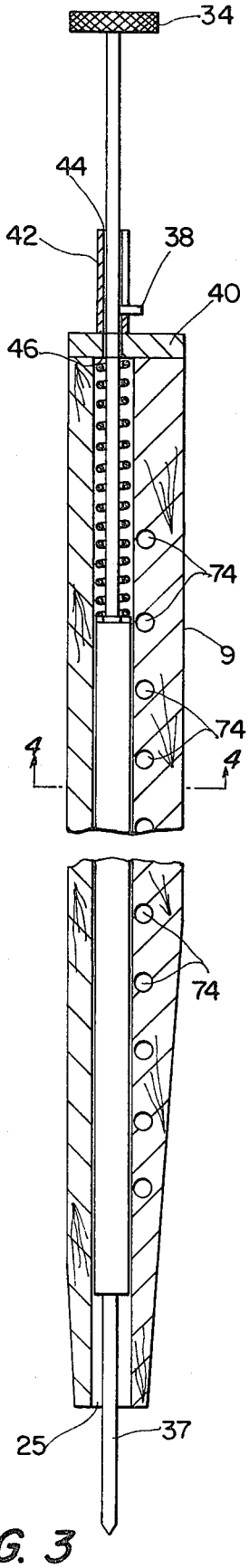
FIG. 3

CRUTCH CONTAINING A RETRACTABLE METAL POINT

BACKGROUND OF THE INVENTION

1. Field of Invention

This invention relates to an adjustable crutch having a spring-loaded retractable metal point or spike element.

2. Description of the Prior Art

Adjustable crutches having a retractable point or spike are known in the art such as in U.S. Pat. Nos. 39,684; 332,684; 404,303; 1,652,110; 2,358,853; 3,646,949; 3,757,807 and 3,901,258. All of these crutches have serious shortcomings, however, as demonstrated by the fact that none to our knowledge have gained commercial success. For example, each of these prior art crutches suffer from one or more of the following shortcomings:

(a) The crutch cannot be quickly and conveniently modified from a structure adapted for outdoor use to one adapted for indoor use.

(b) The point or spike of the crutch is often rigid and consequently has a tendency to bend or break when called on to support the user's entire weight. Additionally, rigid points (as opposed to spring-loaded) tend to slip on hard ice if they do not make immediate penetration on contact with the ice.

(c) The crutch is unable to accommodate irregular surfaces when the spike is in projected position.

(d) No adjustment is possible to change point pressure.

(e) The mechanism of the crutch is not sufficiently protected against the elements and may jam or become inoperable in time.

(f) The crutch cannot be adjusted to accommodate changing surface conditions.

(g) The crutch is not strong and safe enough for use by all patients.

These and other shortcomings are all avoided by the present invention.

SUMMARY OF THE INVENTION

In an adjustable crutch comprising an arm rest, longitudinal support members, a handle between said longitudinal support members, a lower central member adjustably positioned between said longitudinal support members and means for securing said central member between said longitudinal members, the improvement wherein said lower central member comprises an elongated element having a longitudinal bore; a metal cap at the upper end of said elongated element, said metal cap having an aperture in axial alignment with said longitudinal bore; means for securing said metal cap to said elongated element; an open-ended hollow cylindrical hub connected to said metal cap, the openings in said hub being in axial alignment with the aperture in said metal cap, said hub having at least one longitudinal slot; a first retractable elongated metal rod provided at one end with a point, said retractable elongated metal rod being positioned in said longitudinal bore so that said pointed end projects below the bottom end of said element; a second retractable elongated metal rod of reduced diameter relative to the diameter of said first elongated metal rod connected to the other end of said first elongated metal rod and being in longitudinal alignment therewith, said second elongated metal rod extending through the aperture in said metal cap and said hub; spring means circumscribing said elongated metal rod and extending between said metal cap and said first elongated metal rod for applying a spring loading to said first elongated metal rod when in projected position; a pin connected to said second elongated metal rod, said pin projecting radially outwardly through the slot of said hub; locking means for said pin located at the top of said hub; means connected to the other end of said second elongated metal rod for manually pulling said second elongated metal rod to simultaneously retract said first elongated metal rod, compress said spring means and bring said pin into locking position; a resilient end cap having an axial bore frictionally positioned over the end of said elongated element, said resilient cap including a centrally apertured metal plate disposed in the lower portion thereof transversely to the axis of said bore, said central aperture being of reduced diameter so as to closely receive the pointed end of said first elongated metal rod.

In a preferred embodiment the improvement of the invention contains adjusting means disposed between the spring means and the first elongate metal rod for the purpose of adjusting the tension of the spring means enabling modification of the spring loading on the first elongated metal rod.

In another embodiment of the invention, the first elongated metal rod comprises a first main rod portion and a second rod portion of reduced diameter connected to said first main rod portion, the bottom of said second rod portion being pointed. Advantageously, the second rod portion is connected to the main rod portion by being threaded into the end thereof. In this way the length of the second rod portion is adjustable by the degree of the receiving threads in the end of said second rod portion.

THE DRAWINGS

FIG. 1 is a front view of a crutch with the point of the retractable metal rod in projected position;

FIG. 2 is a longitudinal section along line 2—2 in FIG. 1;

FIG. 3 is a longitudinal section taken along line 3—3 of FIG. 2 but with the resilient end cap of the crutch removed;

FIG. 4 is a cross-section taken along line 4—4 of FIG. 3;

DETAILED DESCRIPTION OF THE INVENTION

Figure 5:
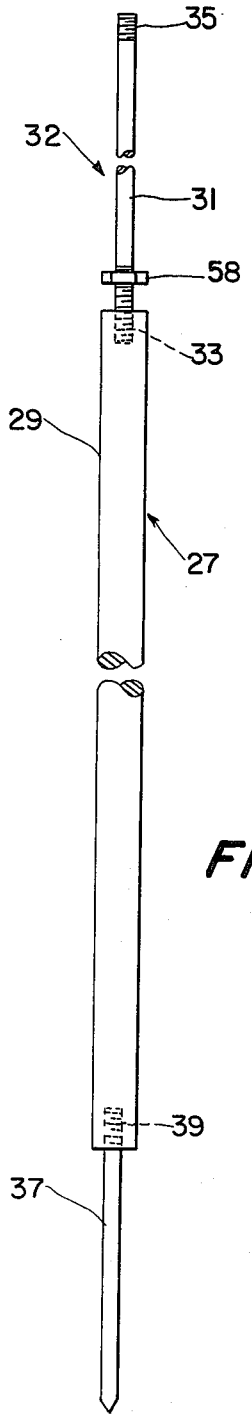
FIG. 5 is an elevational view of the connected retractable elongated metal rods of the invention removed from the elongated element that houses them.

Referring to the drawings, there is shown a conventional type of crutch 3 having longitudinal support members 5 and 7 which converge in their lower portion to receive therebetween an adjustable central member 9. The adjustable central member is secured between the longitudinal support members by screws 11 and 13 containing wingnuts 15 and 17, respectively. A resilient cap 19, is provided in the end of the adjustable central member. The top of the crutch has the usual armrest 21. Below the armrest 21 a handle 23 is secured between the longitudinal support members 5 and 7 by a screw 17 and wingnut 18.

The adjustable central member 9 of the invention is provided therethrough with a longitudinal bore 25 which receives a center rod 27 best shown in FIG. 5. The center rod 27 is basically an assembly of two rod sections, a first retractable elongated metal rod 29 and a second elongated retractable rod section 31 of reduced diameter. The second rod section 31 contains a threaded section 33 by which it is secured to the first retractable rod 29. The opposite end of second rod section 31 also contains a threaded portion 35 for securing thereto a knurled knob 34. A threaded hole is provided between the threaded sections 33 and 35 for receipt of a pin 38. (See FIG. 2 and FIG. 3). In a preferred embodiment the first elongated rod 29 is comprised of a main rod portion and a pointed or spiked end portion 37. One tip of the pointed or spiked end rod portion 37 has a threaded section 39 by which it is inwardly threadedly engaged within the end of the first elongated rod portion 29. The threaded nature of the pointed end portion 37 permits it to be adjusted, that is, shortened or lengthened.

The upper end of the elongated element 9 is provided with a metal cap 40 attached by means of screws 41 to the central member 9 by means of plates 36 and 36', respectively. Plates 36 and 36' are attached to cap 40 by means of screws 43 and to the central member 9 by means of screws 41. (See FIG. 6). Cap 40 has connected thereto a hub 42 which is a hollow metal cylinder having open ends 44 and 46, respectively. The internal diameter of the hub is large enough to allow passage therethrough of a second rod section 31. A longitudinal slot 48 through which pin 38 projects radially outwardly is cut down the hub. (See FIG. 6). The top of the hub contains knotched seats 54 and 56, respectively in either of which pin 38 rests when in locked position, that is, when the center rod is in retracted position.

The threaded section 33 of second rod section 31 is provided with a nut 58. Between nut 58 and the bottom face of cap 40, is mounted a coiled spring 60 about second rod section 31. Nut 58 serves as a means for adjusting the tension on said coiled spring 60 and thereby changing the spring loading on the first elongated metal rod 29.

Resilient end cap 19 is frictionally positioned over the bottom end of central member 9 which has been tapered to be centralized around the center of rod 27. The resilient end cap 19 contains an axial bore 64 in which is disposed a metal plate 66 having central aperture 68 through which spiked rod portion 37 can project.

Adjustable member 9 is normally constructed of wood but any strong durable material can be used. The hardware employed in the adjustable member 9 of the invention is preferably made of a light weight metal such as aluminum, except for the pointed end portion 37, spring 60, pin 38 and metal plate 66 all of which are advantageously made of steel.

The bore 25 of the adjustable member 9 can be formed by any suitable means as by drilling through the length of the member. As shown in FIG. 4, however, the bore 25 is formed by cutting a channel 70 along a longitudinal side of adjustable member 9 and covering it with cover piece 72. A plurality of holes 74 pass through member 9 perpendicular to bore 25 so that the member 9 can be adjusted relative to longitudinal support members 5 and 7.

Figure 6:
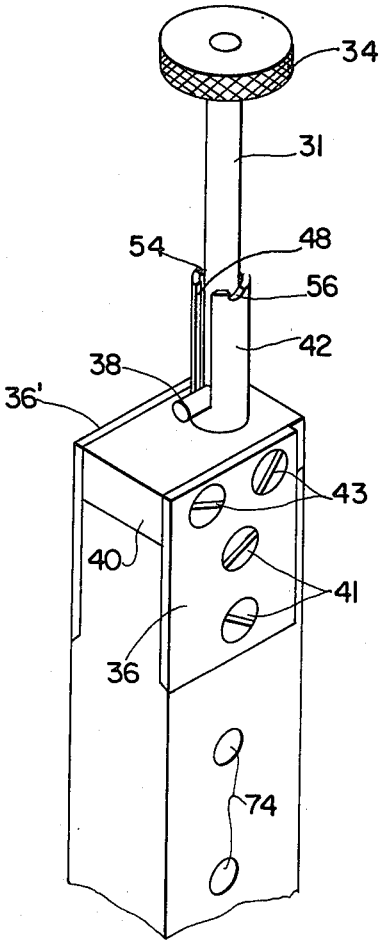
FIG. 6 is a top elevational view of the adjustable lower central member in projected position.

In operation, when the crutch is used on icy or otherwise slippery walking areas the pointed end portion 37 projects below the base of resilient cap 62 normally approximately 1 to 2 inches. In this position the pin 38 rests at the base of slot 48 as shown in FIG. 6 and the pointed end portion 37 is in projected position and always under spring load by coiled spring 60. Thus, the pointed end portion has movement under varying pressure to accommodate irregular surfaces. In addition, the patient's weight on the resilient end cap 19 is spread more between the pointed end portion 37 and the end cap 19. Consequently, pointed end portion 37 does not need to support all the patient's weight as rigid points would require. The length the pointed end portion 37 projects can be adjusted to a greater or less distance depending upon the conditions of the walking area by simply screwing the pointed end portion 37 further in or further out of adjustable member 9. For instance, where the conditions involve more snow and less hard ice, it may be desirable to use a greater length of projection.

Similarly, the point pressure can be changed to accommodate patients of various weight by turning nut 58 to vary the spring tension.

During normal operating use, that is, when the crutch is to be used indoors or outdoors under non-icy or non-slippery conditions, the projected point end portion 37 is retracted by pulled knurled knob 34 upward until pin 38 moves out of slot 48 and then twisting knurled knob 34 to rotate pin 38 to lock it in seat 54 or seat 56 on top of hub 42. When slippery conditions require, the user of the crutch, with no inconvenience and without removing the crutches from under the arms, simply rotates knob 34 to actuate the internal mechanism and immediately extend the pointed end portion 37 into projecting position and under spring loading.

The foregoing is considered as illustrative only of the principles of the invention. Further, since numerous modifications and changes will readily occur to those of ordinary skill in the art it is not desired to limit the invention to the exact construction and operation shown and described, and accordingly, all suitable modifications and equivalents may be resorted to, falling within the scope of the invention.

It is claimed:

1. In an adjustable crutch comprising an arm rest, longitudinal support members, a handle between said longitudinal support members, a lower central member adjustably positioned between said longitudinal support members and means for securing said central member between said longitudinal members, the improvement wherein said lower central member comprises:

an elongated element having a longitudinal bore, a metal cap at the upper end of said elongated element, said metal cap having an aperture in axial alignment with said longitudinal bore, means for securing said metal cap to said elongated element, an open-ended hollow cylindrical hub connected to said metal cap, the openings in said hub being in axial alignment with the aperture in said metal cap, said hub having at least one longitudinal slot, a first retractable elongated metal rod provided at one end with a point, said first retractable elongated metal rod being positioned in said longitudinal bore so that said pointed end projects below the bottom end of said element, a second retractable elongated metal rod of reduced diameter relative to the diameter of said first elongated metal rod connected at one end to the other end of said first elongated metal rod and being in longitudinal alignment therewith, said second elongated metal rod extending through the aperture in said metal cap and hub, spring means circumscribing said elongated metal rod and extending between said metal cap and said first elongated metal rod for applying spring loading to said first elongated metal rod when in projected position, a pin connected to said second elongated metal rod, said pin projecting radially, outwardly through the slot of said hub, locking means for said pin located at the top of said hub, means connected to the other end of said second elongated metal rod for manually pulling said second elongated metal rod to simultaneously retract said first elongated metal rod, compress said spring means and bring said pin into locking position, a resilient end cap having an axial bore frictionally positioned over the end of said elongated element, said resilient cap including a centrally apertured metal plate disposed in the lower portion thereof transversely to the axis of said bore, said central aperture being of reduced diameter so as to closely receive the pointed end of said first elongated metal rod.

2. The improvement according to claim 1 including adjusting means disposed between said spring means and said first elongated metal rod for adjusting the spring means to change the spring loading on said first elongated metal rod.

3. The improvement according to claim 2 wherein the first elongated metal rod comprising a first main metal rod portion and a second rod portion of reduced diameter connected to said first main rod portion, the tip of said end portion being pointed.

4. The improvement according to claim 3 wherein the end portion is of reduced diameter and is threaded into the end of said main portion.

5. The improvement of claim 1 wherein the elongated element contains a plurality of spaced-apart holes along the length thereof for adjustment of said elongated element relative to the longitudinal support members.

* * * * *